US009359748B1

(12) United States Patent
Lamy et al.

(10) Patent No.: US 9,359,748 B1
(45) Date of Patent: Jun. 7, 2016

(54) SHOWER DEVICE WITH MULTI-PRODUCT DISPENSING CAPABILITY

(71) Applicants: Anthony J. Lamy, Batavia, IL (US); Paul B. Englram, Oak Park, IL (US)

(72) Inventors: Anthony J. Lamy, Batavia, IL (US); Paul B. Englram, Oak Park, IL (US)

( * ) Notice: Subject to any disclaimer, the term of this patent is extended or adjusted under 35 U.S.C. 154(b) by 0 days.

(21) Appl. No.: 14/544,527

(22) Filed: Jan. 15, 2015

(51) Int. Cl.
*A62C 5/02* (2006.01)
*E03C 1/046* (2006.01)
*B05B 1/18* (2006.01)

(52) U.S. Cl.
CPC .. *E03C 1/046* (2013.01); *B05B 1/18* (2013.01)

(58) Field of Classification Search
CPC ..... B05B 1/18; B05B 7/2462; B05B 7/0408; B05B 7/1209; E03C 1/046; B65D 85/808
USPC ..... 239/310, 314, 316–318, 409
See application file for complete search history.

(56) References Cited

U.S. PATENT DOCUMENTS 3,333,601 A 8/1967 Lofgreen
3,446,438 A 5/1969 Watson
3,447,753 A 6/1969 Proctor et al.
4,047,541 A 9/1977 Mercier et al.
4,218,013 A 8/1980 Davison
4,219,158 A 8/1980 Lacy
4,358,056 A 11/1982 Greenhut
4,901,765 A * 2/1990 Poe ..... E03C 1/046 137/893
5,333,789 A 8/1994 Garneys
6,006,374 A * 12/1999 Winnett ..... E03C 1/046 239/312
8,028,933 B2 * 10/2011 Friis ..... A47K 3/281 239/310
8,070,074 B2 * 12/2011 Craig ..... B01F 5/0496 239/310
2010/0270399 A1 * 10/2010 Chambers ..... B01F 5/0496 239/318
2013/0186971 A1 7/2013 Bishop

* cited by examiner

*Primary Examiner* — Davis Hwu
(74) *Attorney, Agent, or Firm* — Philip H. Kier

(57) ABSTRACT

A two-stage coaxial shower head that allows conventional water flow through the shower head or a mixture of product and water through a product low flow nozzle. The product may be such liquids as soap, moisturizer, shampoo, or hair conditioner. Products are contained within product pressure reservoirs each with a product section and a piston. During a shower, a user rotates a selector dial at the multi-ported spool valve to select a product or conventional water flow for rinsing. When a product is selected water flow through a water supply tube from the multi-ported spool valve to the shower head will cease and pressure to force water down to the lower part of a product reservoir to raise the piston in the product pressure reservoir to reject product that is transported to a shower head section. A version using electronics instead of hydraulics is also presented.

6 Claims, 9 Drawing Sheets

SHOWER DEVICE WITH MULTI-PRODUCT DISPENSING CAPABILITY

BACKGROUND OF THE INVENTION

The present invention is a device for dispensing at least one product, in addition to water, through a shower head. More particularly, it is a device that conserves product, by using a coaxial shower nozzle that has separate flow channels for water and the product selected by a user.

The prior art contains a variety of shower devices that mix water and a product, such as soap or shampoo, in a shower head. One such device as taught by Greenhut, et al in U.S. Pat. No. 4,358,056 uses a coupling that produces a venturi effect to pass shower water and draw in a liquid product from a reservoir. Garneys in U.S. Pat. No. 5,333,789 teaches the use of an insert located between a water inlet pipe and a shower head that diverts the water to a reservoir containing product where the water mixes with the product before entering the shower head. The device taught by Lacy in U.S. Pat. No. 4,219,158 uses a mixer disc in a shower head to intimately water spray with one or two products in a reservoir. The device taught by Davison in U.S. Pat. No. 4,218,013 uses an insert between a shower head and a water inlet pipe to introduce a product stored in a reservoir and selected by a valve into the water stream entering the shower head.

Most other shower head mixing devices, such as the shower soap dispenser taught by Bishop in U.S. Patent Application US 2013/0186971, use a vacuum-Venturi effect to draw a product into the water flow. This requires a very high vacuum to operate properly and generates noise because of the high velocity of fluid traveling across the Venturi. The instant invention uses pressure to force the flow of product into the shower head to eliminate the noise from the Venturi operation. Conventional shower hear mixing devices do not allow for fine regulation of the concentration of a product in the water flow leaving a shower header. Too often the product is too dilute in the stream leaving the shower head. This wastes the product and the water in the stream. In contrast, the instant invention has a two-stage coaxial shower head that allows for either conventional water flow or a low rate flow of water and product with just enough water to spray the product on the user's body. This eliminates undue dilution of the product.

SUMMARY OF THE INVENTION

This invention has a two-stage coaxial shower head that allows conventional water flow through the shower head or a mixture of product and water through a product low flow nozzle. The product may be such liquids as soap, moisturizer, shampoo, or hair conditioner. Products are contained within product pressure reservoirs. There may be more than one such reservoir. In fact, it is preferred to have more than one product, so that, for example, soap and moisturizer can be dispensed in succession. In the drawings, two reservoirs are shown for illustration. During a shower, a user rotates a selector dial at the multi-ported spool valve to select a product or conventional water flow for rinsing, When a product is selected water flow through a water supply tube from the multi-ported spool valve to the shower head will cease. This will cause the pilot operated shut-off valve in the shower head mechanism to close, which in turn will cause water to stop flowing through water high flow head and will redirect pressure to force water down through the water pressure supply tube to the multi ported spool valve and the selected product pressure reservoir's water pressure supply tube. A differential pressure is set up that will force product in this reservoir chamber up from the top of the reservoir through a product supply tube into the stage 1 mix chamber in the shower head mechanism. At the same time, water will be passing through the low flow adjustment valve into the stage 1 mix chamber where it will mix with the selected product. After further mixing in the stage 2 mix chamber, the product-water mixture will exit the shower head through the product low flow nozzle.

The invention has an object of providing a high concentration water-product mixture without waste of water and product from excess dilution of product. Efficient use of water is made possible by use of a pilot operated shut-off valve. Another object is to provide the user with the ability to control the speed and concentration of the of the product flow to the product low flow nozzle by use of a flow control dial. Still another object is to allow a user to apply different produces in succession on parts of the body that are difficult to reach by hand.

BRIEF DESCRIPTION OF THE SEVERAL VIEWS

DETAILED DESCRIPTION OF THE INVENTION

Figure 1:
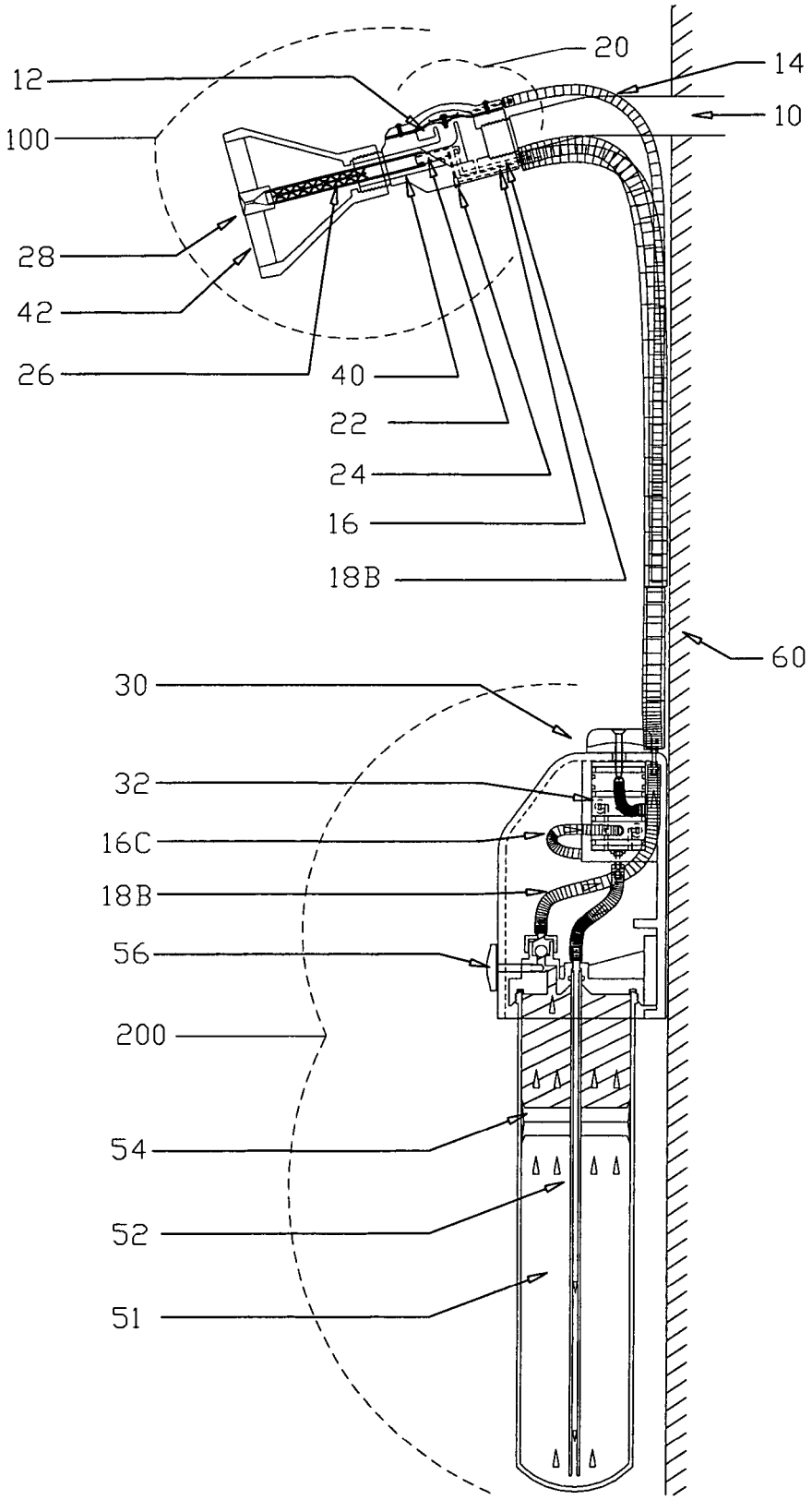
FIG. 1 is a side view of the invention.

In the preferred embodiments, and as shown in FIG. 1 through FIG. 7, the invention has two main assemblies: a shower head assembly 100 and below it a product supply assembly 200, the two assemblies being connected by tubes. A water supply 10 that emerges from a wall 60 enters an intermediate section 20 of the shower head assembly. If a selection dial 30 located at the top of the product supply assembly is not set to a product, but rather to water rinse 59 a pilot operated shut-off valve 12 in the intermediate section of the shower head assembly will be open and water will pass through the intermediate section to a coaxial head 40 and to a water high flow head 42 as in a conventional shower head.

Figure 2:
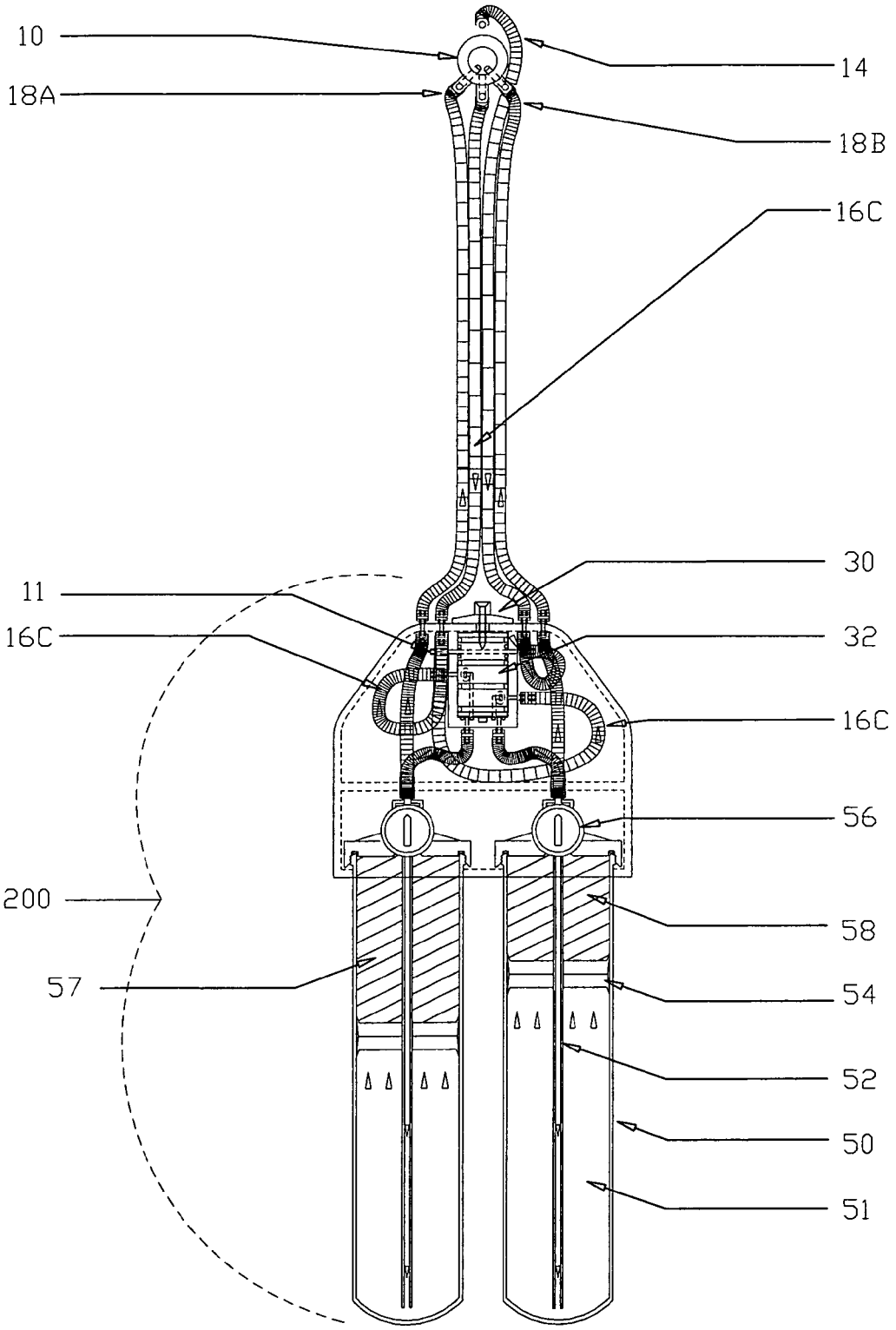
FIG. 2 is a front view of the invention.
Figure 3:
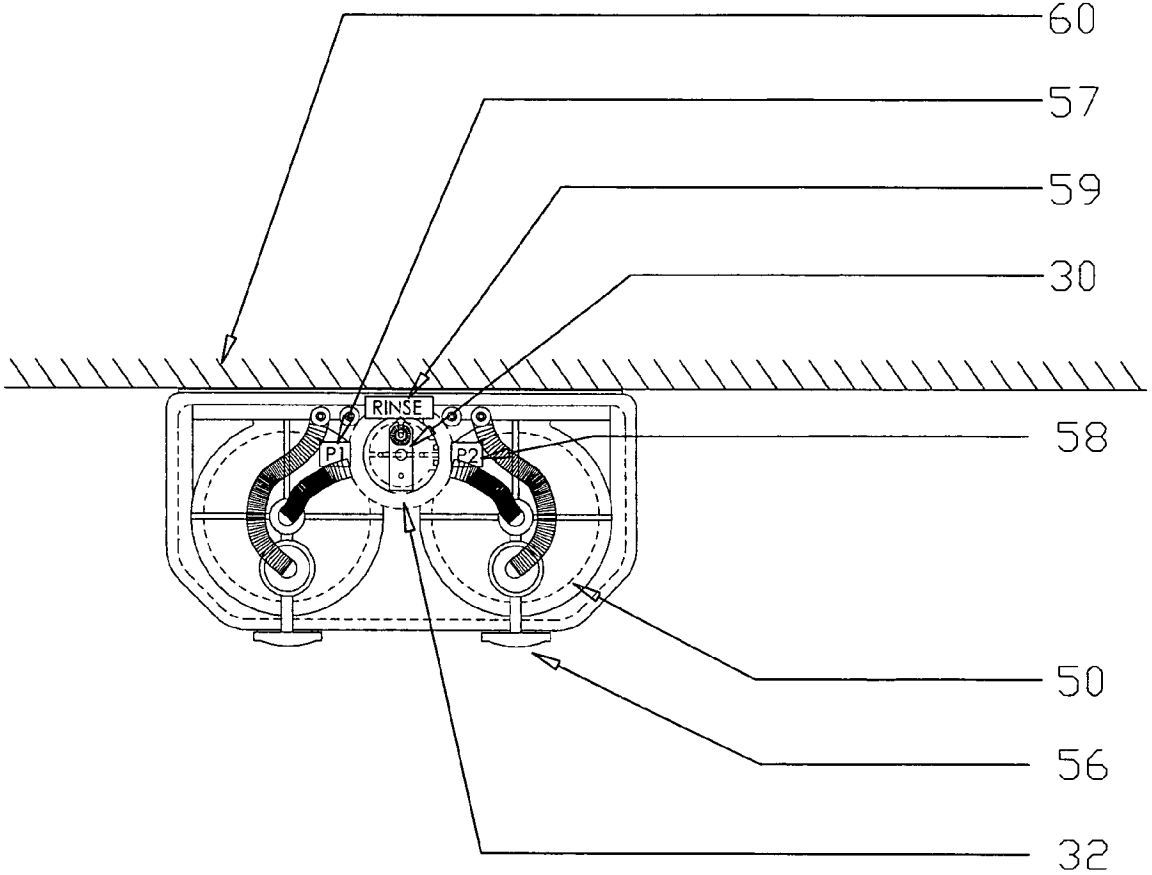
FIG. 3 is a top view of the part of the invention with the product pressure reservoirs.

A pilot operated control tube 14 extends to the pilot operated shut-off valve 12 in the shower head assembly from a multi ported spool valve 32 in the product supply assembly that is controlled by the setting of the selection dial 30. When the selector dial is set to a product, either P1 57 for product 1 or P2 58 for product 2, water flow through the pilot operated control tube 14 will be turned off. This will cause the pilot operated shut-off valve 12 to close, thus stopping water flow through the water high flow head 42 and redirecting pressure to force water through a water pressure supply port 16A which flows through channel 16 and through tube 16C, to =multi-ported spool valve 32 and to the selected product pressure reservoir's 50 water pressure supply tube 52. Each product pressure reservoir has a product separation piston 54 that separates water in the lower part of the reservoir from product in the higher part. This piston 54 has resilient sealing surface at the outside diameter which seals against the inside diameter of product pressure reservoir's 50 and at the inside diameter which seals against the outside diameter of supply tube 52. The water flowing into the lower part of a product pressure reservoir 51 from the water pressure supply valve sets up a differential pressure that causes the produce separation piston to rise thereby forcing product up from the top of the product pressure reservoir 50 through the product supply tube 18B (for the right hand product pressure reservoir as shown in FIG. 2) into the stage 1 mix chamber 22 in the shower head assembly.

A flow control dial 56 at the head of each product pressure reservoir can be used to control the speed of the product entering the product supply tube, and the concentration of the mixture of product and water comes out of the product low flow nozzle 28. At the same time, a small amount of water from the water supply will be passing through a slow flow adjustment valve 24 into the stage one mix chamber 22 to begin mixing with the product. This water will mix further with the product as it passes through a stage 2 mix chamber 26 and out of the product low flow nozzle 28. Valve 24 can be closed off to allow only product to flow out nozzle 28 if desired.

Figure 4A:
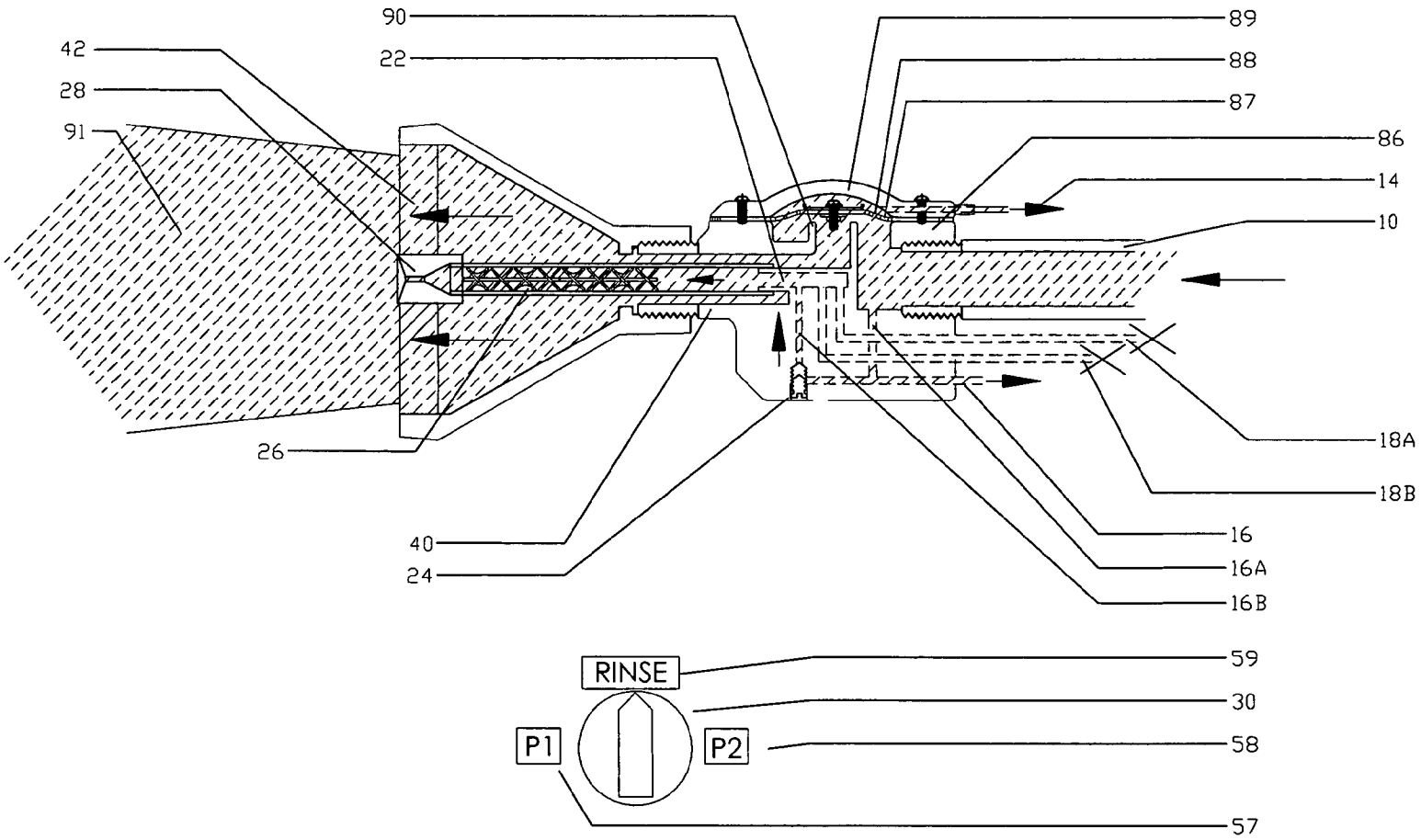
FIG. 4A shows the liquid flow through the shower head when the selector dial is set art rinse.
Figure 4B:
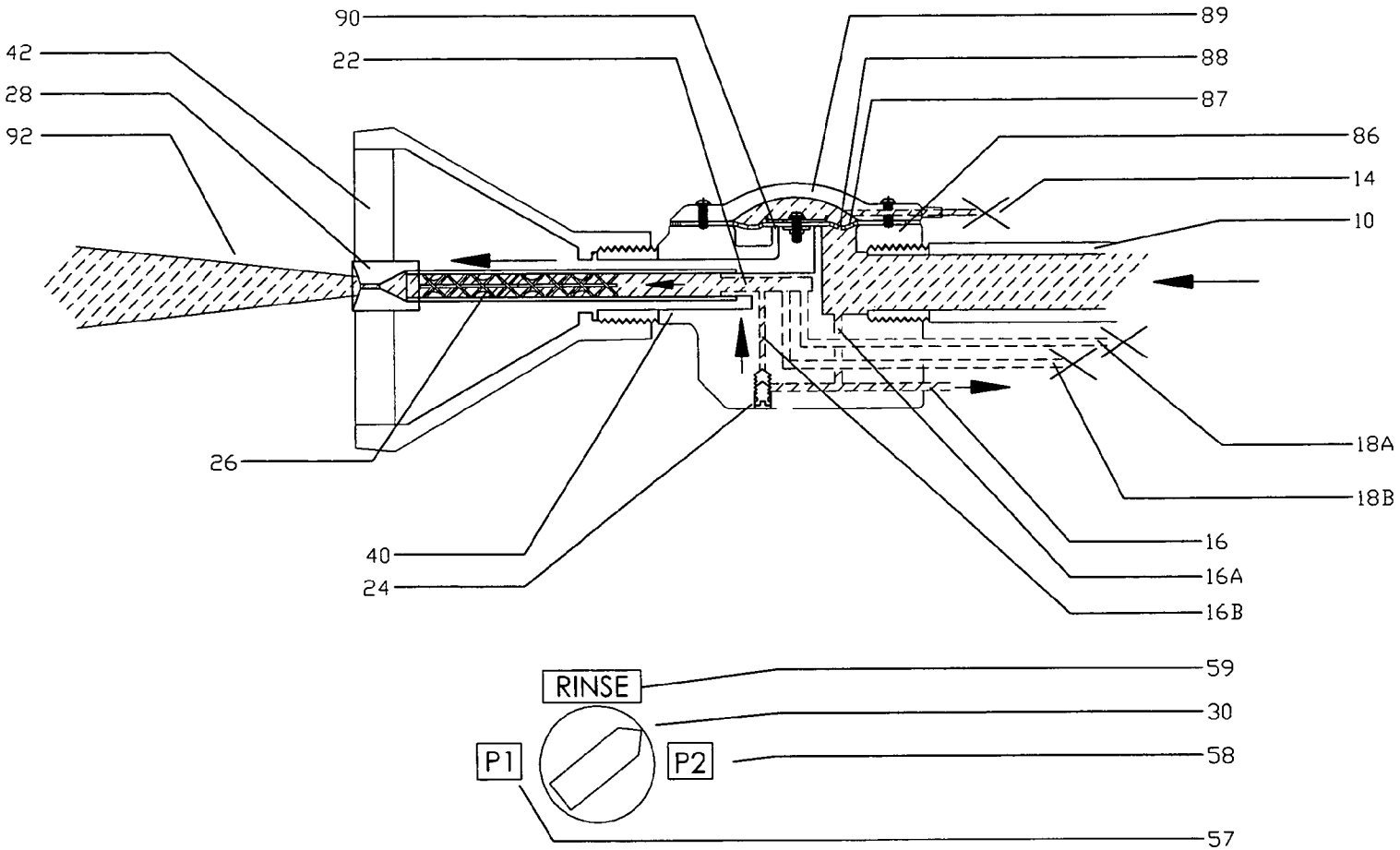
FIG. 4B shows the liquid flow through the shower head when the selector dial is set intermediate between rinse and a product

If the selector dial 30 has a position intermediate between rinse water and a product as shown in FIG. 4B, the pilot operated shut-off valve will be closed causing liquid in the shower head to leave the shower head through the product low flow nozzle 28. However, for this selector dial position, the multi-ported valve 32 will be closed so that product will not pass through a product supply valve. Hence, only a low flow of water will leave the product low flow nozzle.

FIG. 4A shows a detail of shower head assembly 100 with the selector dial 30 set toward RINSE 60. In this position, the multi-ported spool valve 32 aligns internal port 73, connecting ports 63 and 72. This allows the water pressure above diaphragm 87 in the shower head assembly to pass through a hole in this diaphragm 88 into the cavity created by cap 89 which forces this flow to tube 14 and to the drain at port 11 on assembly 200. This allows diaphragm 87 to lift and open flow of water from water source 10 through the valve seat 90 and out through annular space to the water high flow head 42. Cap 89 creates a pressure chamber for the valve, above the diaphragm 87 and has a vent channel and tube 14. Item 89 is screwed or clamped onto valve housing 86.

FIG. 4B shows a detail of shower head assembly 100 with the selector dial 30 set between RINSE 59 and the product 2 (P2) setting 58. In this position the multiported spool valve 32 shuts the connection between ports 63 and channel 73. This stops the water from draining out of port 11 and causes the water pressure above diaphragm 87 to build and force the diaphragm down, causing it to close onto valve seat 90. This closes off the water flow to the high flow head and only allows flow through port 16A and channel 16 and slow flow adjustment valve 24 which flows through channel 16B to the low flow nozzle 28, shown as stream 92.

Figure 4C:
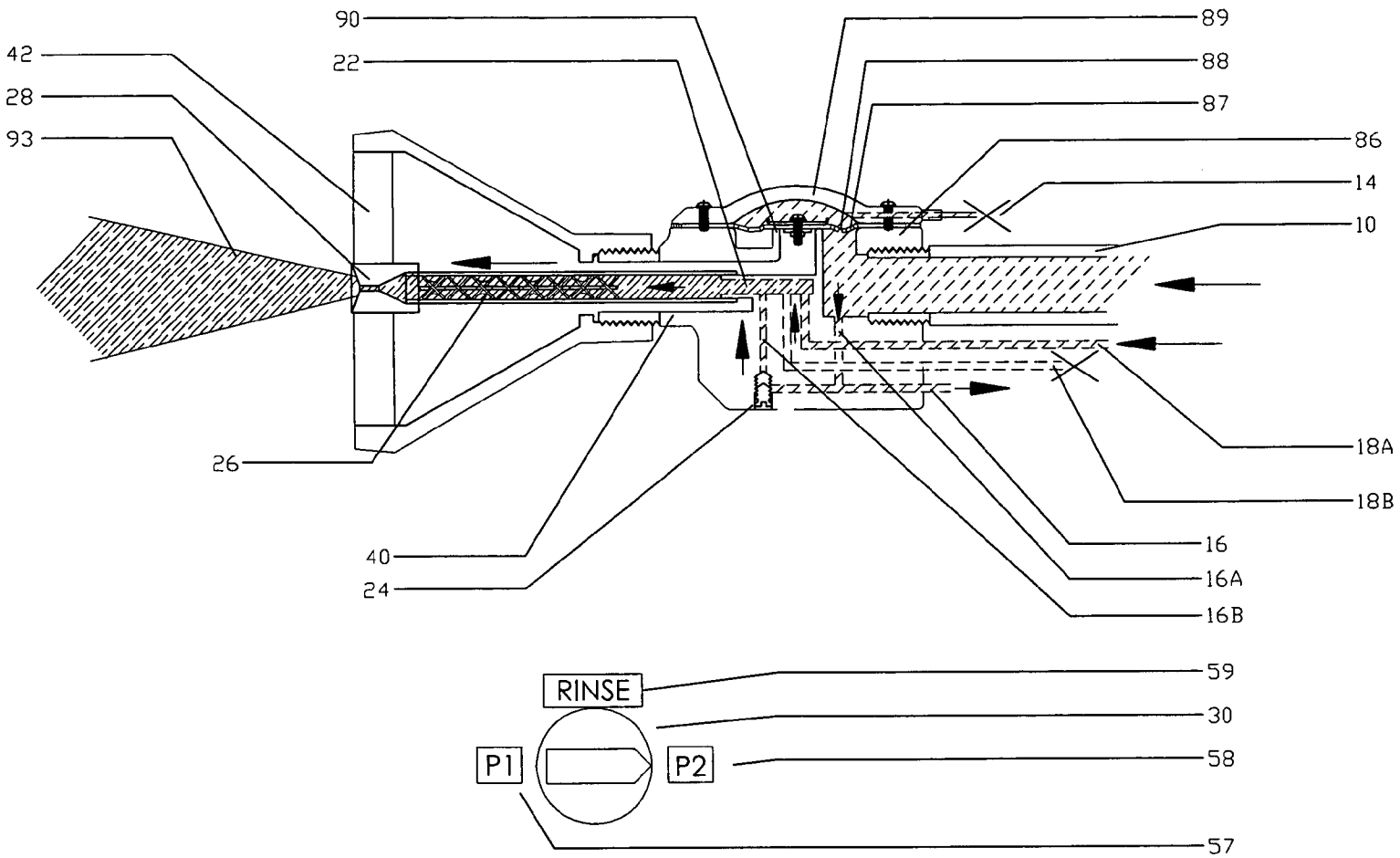
FIG. 4C shows the liquid flow through the shower head when the selector dial is set to a product.

FIG. 4C shows a detail of shower head assembly 100 with the selector dial 30 set to the product 2 (P2) setting 58. In this position the multi-ported spool valve 32 shuts off the connection between ports 63 and –. This stops the water from draining out of port 11 and causes the water pressure above diaphragm 87 to build and force the diaphragm down to close the diaphragm on to valve seat 90. This closes off the water flow to the high flow head and only allows flow through port 16A and channel 16 and slow flow adjustment valve 24 which flows through channel 16B to the low flow nozzle 28. Water flows from channel 16 through the water pressure supply tube 16C to the ports 65 and 71 on the multi-ported spool valve 32. When this valve is in the P2 position, it will allow water pressure to flow out of port 67 through down tube 52 applying force to the lower area 51 of product pressure reservoir's 50, as shown in FIG. 2. This will drive up the product separation piston 54 and applies pressure to the product above a plate through valve 56 and up tube 18B and into the back of stage one mix chamber 22, through the inline mix chamber 26. This provides a combined controlled mixture of water and product that leaves the shower head assembly through low flow nozzle 28, the mixture being shown as stream 93.

Figure 5:
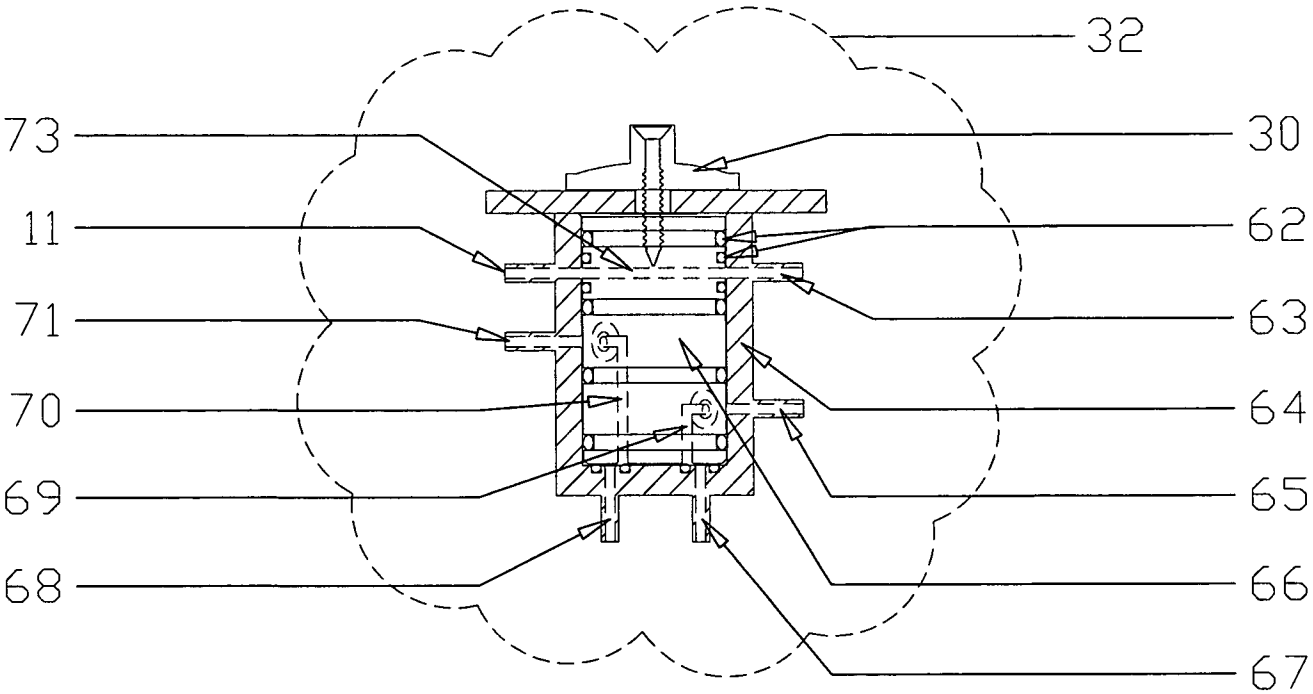
FIG. 5 shows a side view of the spool valve assembly.
Figure 6:
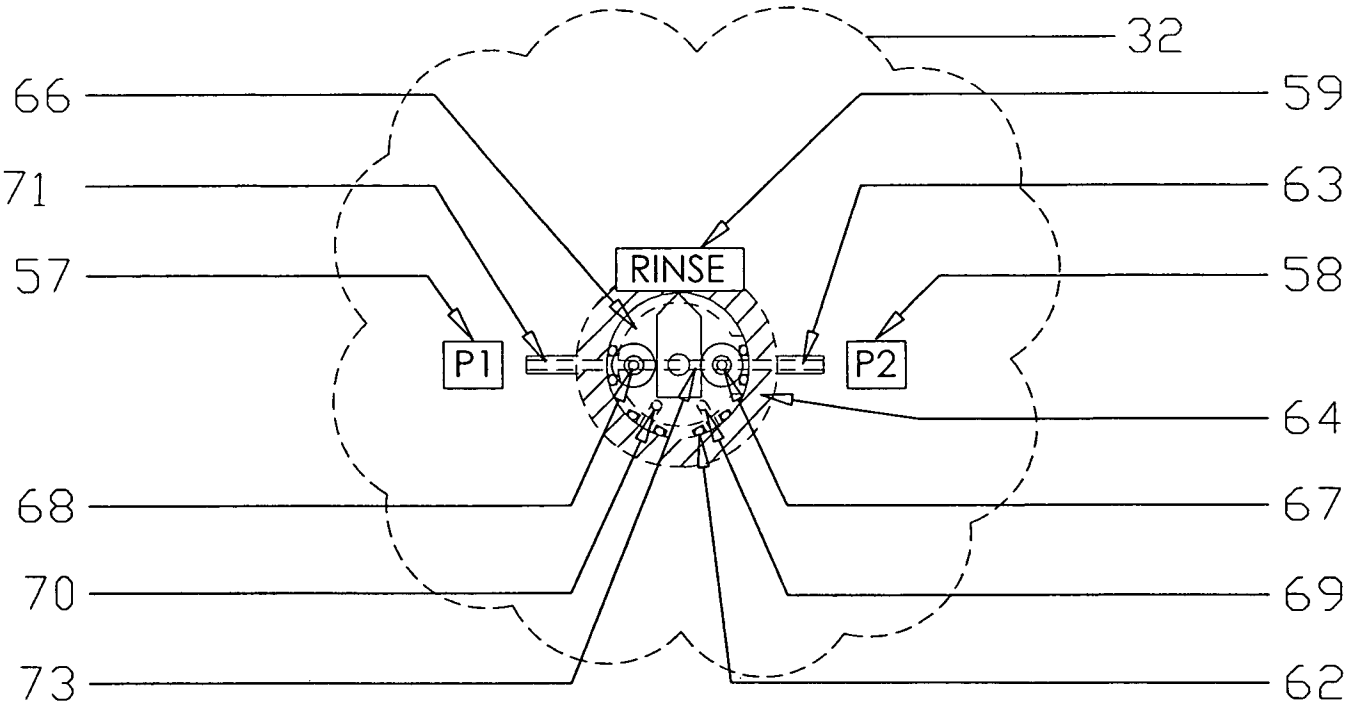
FIG. 6 shows the top view of the spool valve assembly and selector dial.

FIG. 5 and FIG. 6 each show a view of the multi-ported spool valve 32. These drawings show the valve body 64 and the spool valve 66, which is rotated by selector dial 30. The chambers of the valve are sealed by O-ring 62. With the selector dial in the RINSE position 59, the valve allows flow in ports 63 and out port 11. In the P1 57 position, the valve allows water flow through ports 71, aligns the spool valve 66 so channel 70 connects 71 and 68. This allows the increased water pressure to flow to the lower water side 51 of product pressure reservoir 50, to force the product up to the shower head assembly 100 via product tubes 18A. In the P2 58 position, the valve allows water flow through ports 65, aligns the spool valve 66 so channel 69 connects 65 and 67. This allows the increased water pressure to flow to the lower water side 51 of product pressure reservoir 50, to force the product up to the shower head assembly 100 via product tubes 18B.

Figure 7:
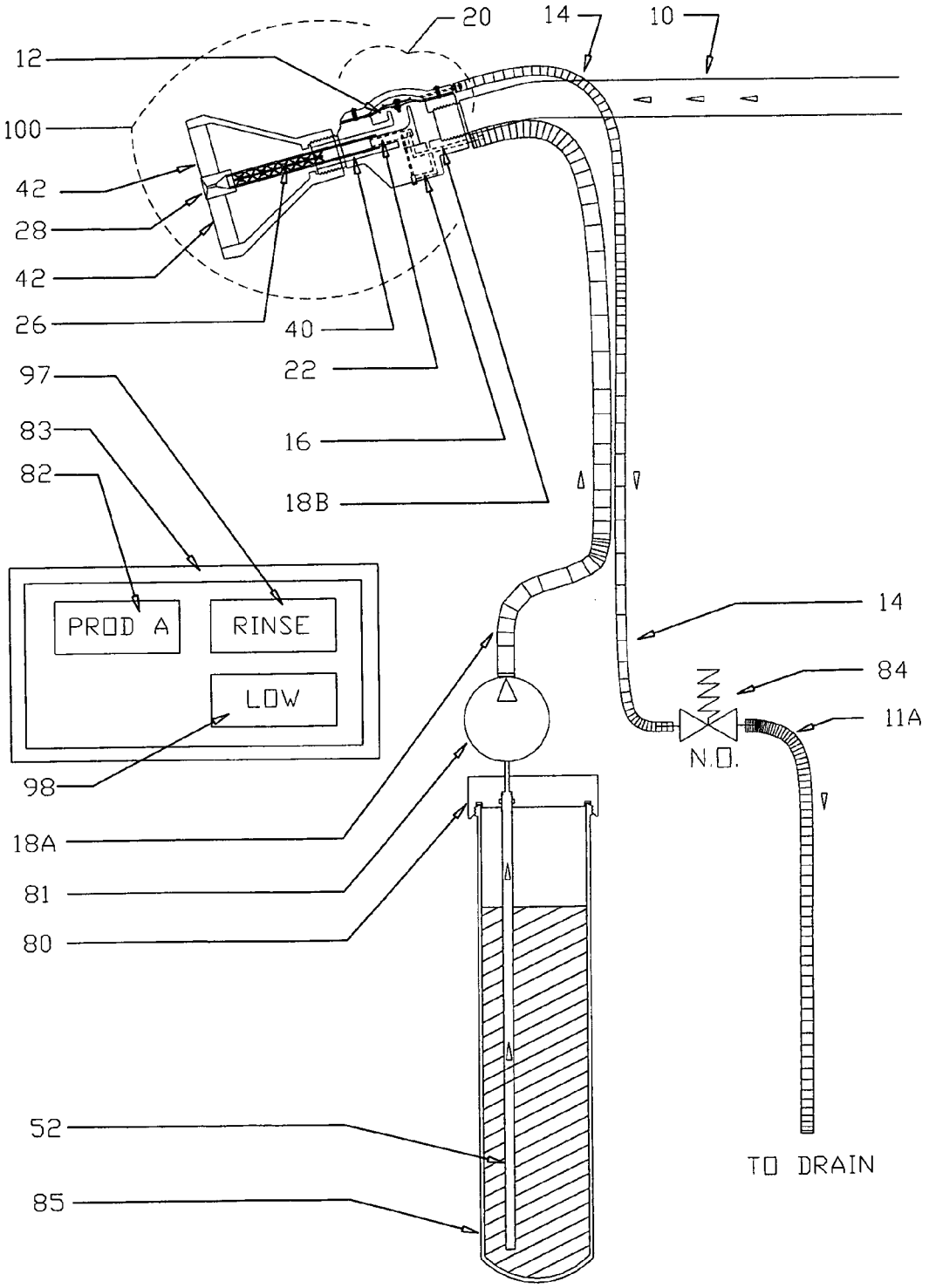
FIG. 7 shows the device with an electric product pump instead of a hydraulic pump and an electrically operated valve with a electrical touch pad instead of a spool valve.

In an alternative embodiment, valves are controlled electrically rather than hydraulically. Electrically controlled valves and a product pump are used instead of a product pressure reservoir 50 as shown in FIG. 7. Product is pumped to the shower head when the Product A button is pressed on a touch pad 83. There may be multiple products. One product is shown in FIG. 7 for clarity. The choices of Product A, Rinse, or Low, equivalent to a selector dial setting between rinse and product in the hydraulic embodiment, as described above. Product is stored in a non-pressurized reservoir 85, with reservoir cover 80 and is pumped with an electrically operated pump 81 to the shower head assembly 100 when selected from a touch pad 83 by pressing button 82. When the Rinse button 97 is selected, valve 84 remains open and allows water to drain from tube 11A which keeps the pilot valve 12 in the open position, and water will pass through the intermediate section 20 to a coaxial head 40 and to a water high flow head 42 as in a conventional shower head. The pilot valve 12 can be performed by alternate valve designs using electrical actuation. When the Low button 98 is selected, valve 84 will be energized and will close and stop the water from draining from tube 11A. This forces pilot valve 12 to close so that water will only pass through low flow passage 16 to passage 22 and out low flow nozzle 28. To dispense product, press the product button 82. When Product A button 82 is pressed, valve 84 will close, shutting off drain tube 11A and turning off the high water flow through tube 14 that extends to intermediate section 20. Pump 81 draws the product from tube 52 and pumps it through tube 18A and into the shower head assembly. Conventional battery operated power or direct grid connected power can be used. A rotary switch or other electrical switch device can be used in place of the touch pad, to control the electrical signals.

We claim:

1. A shower device with multiple product dispensing capabilities comprising:

a shower head assembly containing a water supply, a coaxial shower head with a water high flow head and a product flow nozzle, at least one product-water mixing chamber, and a pilot-operated shut-off valve that controls flow of rinse water from the water high flow head;

a product supply assembly containing at least one product pressure reservoir, each product pressure reservoir having a lower part containing water and a upper part containing product, the upper part and the lower part being separated by a piston, and with a tube for supplying water to the lower part; a multi-ported spool valve and an associated selector dial that determine whether the device operates in rinse mode or product dispersing mode, means for conducting product from each pressure product reservoir to a mixing chamber in the shower head assembly;

means for directing water from the shower head assembly to the product supply assembly when the pilot shut-off valve is closed and turning off water flow to the shower head providing product with increased concentration; and a pilot-operated control tube that shuts off water flow from the pilot-operated shut-off valve, closing said valve when the selector dial is set to other than rinse mode.

2. A shower device with multiple product dispensing capabilities as set forth in claim 1 further comprising a low flow adjustment valve directing water from the water supply to a product mixing chamber to mix with product, this low flow adjustment valve being able to turn off this mixing water flow and only allow product.

3. A shower device with multiple product dispensing capabilities as set forth in claim 2 wherein the means for conducting product from each pressure product reservoir to a mixing chamber in the shower head assembly is a tube.

4. A shower device with multiple product dispensing capabilities as set forth in claim 2 wherein the means for conducting product from each pressure product reservoir to a mixing chamber in the shower head assembly is a channeled port.

5. A shower device with multiple product dispensing capabilities as set forth in claim 3 wherein the means for directing water from the shower head assembly to the product supply assembly when the pilot shut-off valve is closed is a tube.

6. A shower device with multiple product dispensing capabilities as set forth in claim 2 further comprising a flow control dial for each product pressure reservoir to control the speed and concentration of the product entering the product supply tube.

* * * * *